US011679484B2

(12) United States Patent
Bantle et al.

(10) Patent No.: US 11,679,484 B2
(45) Date of Patent: Jun. 20, 2023

(54) HAND-HELD POWER TOOL COMPRISING A PERCUSSION MECHANISM

(71) Applicant: Robert Bosch GmbH, Stuttgart (DE)

(72) Inventors: Florian Bantle, Westerheim (DE); Thomas Duerr, Asperg (DE); Juergen Gairing, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 875 days.

(21) Appl. No.: 16/062,090

(22) PCT Filed: Dec. 7, 2016

(86) PCT No.: PCT/EP2016/080129
§ 371 (c)(1),
(2) Date: Jun. 13, 2018

(87) PCT Pub. No.: WO2017/102514
PCT Pub. Date: Jun. 22, 2017

(65) Prior Publication Data

US 2018/0361559 A1 Dec. 20, 2018

(30) Foreign Application Priority Data

Dec. 18, 2015 (DE) ..... 10 2015 226 090.9

(51) Int. Cl.
*B25D 16/00* (2006.01)
*B25F 5/00* (2006.01)
(Continued)

(52) U.S. Cl.
CPC ..... *B25F 5/001* (2013.01); *B25D 11/06* (2013.01); *B25D 11/102* (2013.01);
(Continued)

(58) Field of Classification Search
CPC ..... B25D 16/006; B25D 2216/0084
(Continued)

(56) References Cited

U.S. PATENT DOCUMENTS 7,182,147 B2 * 2/2007 Cutler ..... B25B 21/00 173/1
7,787,981 B2 * 8/2010 Austin ..... G05B 19/41805 700/168
(Continued)

FOREIGN PATENT DOCUMENTS

CN 101777673 A 7/2010
CN 102729220 A 10/2012
(Continued)

OTHER PUBLICATIONS

International Search Report corresponding to PCT Application No. PCT/EP2016/080129, dated Mar. 22, 2017 (German and English language document) (7 pages).

*Primary Examiner* — Thanh K Truong
*Assistant Examiner* — Patrick B Fry
(74) *Attorney, Agent, or Firm* — Maginot, Moore & Beck LLP

(57) ABSTRACT

A hand-held power tool includes a drive unit configured to drive an insertion tool in at least one non-percussive operating mode. The drive unit includes a percussion mechanism for percussive driving of the insertion tool in an associated percussion mode. The hand-held power tool further include a user guidance unit configured to be actuated by a user and a communication interface configured to communicate with the user guidance unit and to receive, from the user guidance unit, changeover instructions for changing over the drive unit between the at least one non-percussive operating mode and the associated percussion mode in an application-specific manner.

2 Claims, 9 Drawing Sheets

(51) Int. Cl.
*B25D 11/10* (2006.01)
*B25D 11/06* (2006.01)
*B25B 21/02* (2006.01)

(52) U.S. Cl.
CPC ..... *B25D 16/003* (2013.01); *B25D 16/006* (2013.01); *B25B 21/026* (2013.01); *B25D 2216/0023* (2013.01); *B25D 2216/0038* (2013.01); *B25D 2216/0084* (2013.01); *B25D 2250/165* (2013.01); *B25D 2250/221* (2013.01); *B25D 2250/265* (2013.01)

(58) Field of Classification Search
USPC ..... 178/48
See application file for complete search history.

(56) References Cited

U.S. PATENT DOCUMENTS 8,794,348 B2 * 8/2014 Rudolph ..... B25B 21/02 173/48
9,652,217 B2 * 5/2017 Winkler ..... B25F 5/00
9,908,182 B2 * 3/2018 Phillips ..... B25F 5/00
2006/0155582 A1 * 7/2006 Brown ..... A61B 5/6896 705/3
2010/0175902 A1 7/2010 Rejman et al.
2013/0327552 A1 * 12/2013 Lovelass ..... B25F 5/00 173/1
2014/0166323 A1 * 6/2014 Cooper ..... B23Q 11/0092 173/1
2014/0367134 A1 * 12/2014 Phillips ..... B25F 5/00 173/176
2016/0167186 A1 * 6/2016 Chan ..... B25F 5/00 173/2
2016/0311094 A1 * 10/2016 Mergener ..... B25B 21/008

FOREIGN PATENT DOCUMENTS

CN 103862444 A 6/2014
DE 10 2011 007 648 A1 10/2012
DE 10 2014 205 555 A1 10/2014
EP 2 848 371 A1 3/2015
WO 2015/061370 A1 4/2015

* cited by examiner

HAND-HELD POWER TOOL COMPRISING A PERCUSSION MECHANISM

This application is a 35 U.S.C. § 371 National Stage Application of PCT/EP2016/080129, filed on Dec. 7, 2016, which claims the benefit of priority to Serial No. DE 10 2015 226 090.9, filed on Dec. 18, 2015 in Germany, the disclosures of which are incorporated herein by reference in their entirety.

BACKGROUND

The present disclosure relates to a hand-held power tool having a drive unit for driving an insertion tool in at least one non-percussive operating mode, wherein the drive unit has a percussion mechanism for the percussive driving of the insertion tool in an associated percussion mode.

The prior art discloses drill/screwdrivers and percussion drill/screwdrivers having a drive unit with a percussion mechanism for the percussive driving of an associated insertion tool in a corresponding percussion mode, wherein the drive unit is assigned an actuatable switching ring for changing over the drive unit between at least one non-percussive operating mode and the corresponding percussion mode. In addition, EP 2 848 371 A1 discloses a drill/screwdriver in which a gear of a planetary transmission assigned to a drive unit is automatically changed over by means of an electrical actuating motor. However, this drill/screwdriver does not have a percussion mechanism.

SUMMARY

The disclosure relates to a new hand-held power tool having a drive unit for driving an insertion tool in at least one non-percussive operating mode, wherein the drive unit has a percussion mechanism for the percussive driving of the insertion tool in an associated percussion mode. A communication interface is provided for the purpose of communicating with a user guidance unit, which can be actuated by a user, and is designed to receive, from the user guidance unit, changeover instructions for changing over the drive unit between the at least one non-percussive operating mode and the associated percussion mode in an application-specific manner.

The disclosure therefore makes it possible to reduce the likelihood of operating errors by the user. For example, the percussion mechanism can be either activated or deactivated on the basis of a specific application scenario, for example drilling into concrete, stone or wood, without the user becoming active. In addition, it is possible to increase the general operating comfort.

According to one embodiment, the user guidance unit is at least partially integrated in the hand-held power tool and/or is at least partially in the form of an external separate component.

Consequently, it is possible to remotely control the hand-held power tool in a convenient and complete manner, for example.

The user guidance unit preferably has a mobile computer, in particular a mobile computer in the form of a smartphone or a tablet computer. Alternatively, other so-called "smart devices", for example a watch, glasses etc., can also be used as the mobile computer.

Comprehensive operations for controlling the hand-held power tool can be implemented thereby by means of the user guidance unit.

The user guidance unit preferably has an interactive program, in particular a smartphone app, for communicating with the communication interface.

Even complex operations for operating the hand-held power tool can thereby take place in a program-controlled manner or automatically, that is to say without user intervention.

The user guidance unit preferably has at least one operating element for initiating a changeover operation for changing over the drive unit between the at least one non-percussive operating mode and the associated percussion mode, wherein the communication interface is designed to transmit a control signal to the at least one operating element in order to make it possible for the at least one operating element to generate a changeover instruction or a request to initiate a changeover operation for changing over the drive unit between the at least one non-percussive operating mode and the associated percussion mode.

A device-side changeover instruction or a request can thereby be issued to the user in order to cause the latter to change over between the at least one non-percussive operating mode and the percussion mode.

The at least one operating element is preferably provided with an illumination means, and the control signal is designed to activate the illumination means to visualize the changeover instruction for initiating a changeover operation for changing over the drive unit between the at least one non-percussive operating mode and the associated percussion mode.

Vivid active user guidance can be implemented with the aid of the at least one illumination means in order to facilitate the operability of the hand-held power tool.

In one advantageous configuration, the at least one operating element is in the form of a switch or button.

Consequently, various haptic actuation possibilities can be implemented for the user.

The at least one operating element preferably has a display, and the control signal is designed to generate an indication for visualizing the changeover instruction for initiating a changeover operation for changing over the drive unit between the at least one non-percussive operating mode and the associated percussion mode on the display.

This makes it possible to transmit a changeover instruction or a request with a greater information content, for example a plain text instruction and/or a graphical symbol or a pictogram, to the user.

In accordance with a technically advantageous configuration, the display is in the form of a touchscreen.

This results in a more enhanced functionality of the display since it also enables user inputs in addition to its indication functionality. In addition, there is a more intuitive operating experience for the user since the symbols or icons indicated on the display can be directly selected by touching them with the finger and the process logically linked to them can be triggered using the (control) electronics.

The at least one operating element can preferably be actuated to initiate a changeover operation for changing over the drive unit between the at least one non-percussive operating mode and the associated percussion mode and has a sensor which is designed to transmit an actuation signal to the communication interface when the at least one operating element is actuated.

Electronic feedback to the electronics relating to the presence of an active user input is consequently possible.

According to one embodiment, an actuating motor is provided and is designed to change over the drive unit between the at least one non-percussive operating mode and the associated percussion mode when activated.

This possibly also makes it possible to change over between the non-percussive operating mode and the percussion mode in a motorized manner which is independent of the user actively taking action. In addition, the actuating motor makes it possible to achieve minimum actuating forces which are always constant for the user and are independent of a respective mechanical switching state of the transmission, the torque clutch and/or the percussion mechanism of the hand-held power tool.

The actuating motor can preferably be activated by actuating the at least one operating element.

It is consequently possible to directly activate the actuating motor solely by means of an active user intervention independently of the mobile computer or complex (control) electronics.

The communication interface is preferably designed to transmit a control signal to the actuating motor for the purpose of activating the actuating motor.

This makes it possible for the communication interface to control the actuating motor automatically, that is to say in a manner dissociated from active actuation of the at least one operating element by the user.

The communication interface is preferably designed to transmit a control signal to actuators of the hand-held power tool, wherein at least one actuator is designed to change over the drive unit between the at least one non-percussive operating mode and the associated percussion mode when activated by the communication interface.

As a result of the at least one actuator, it may be possible to completely control the control mechanism of the hand-held power tool by means of the communication interface in order to change over between the at least one non-percussive operating mode and the percussion mode, for example.

The communication interface is preferably in the form of a wireless transmission module, in particular in the form of a radio module for wireless communication by means of the Bluetooth standard.

This makes it possible to remotely control the hand-held power tool or a tool system consisting of the latter and the mobile computer using standardized radio standards which are interference-free and are compatible to the highest possible degree.

BRIEF DESCRIPTION OF THE DRAWINGS

The disclosure is explained in more detail in the following description on the basis of exemplary embodiments which are illustrated in the drawings. In the drawings, the same structural elements having identical functionalities each have the same reference numerals and are generally described only once. In the drawings.

DETAILED DESCRIPTION

Figure 1:
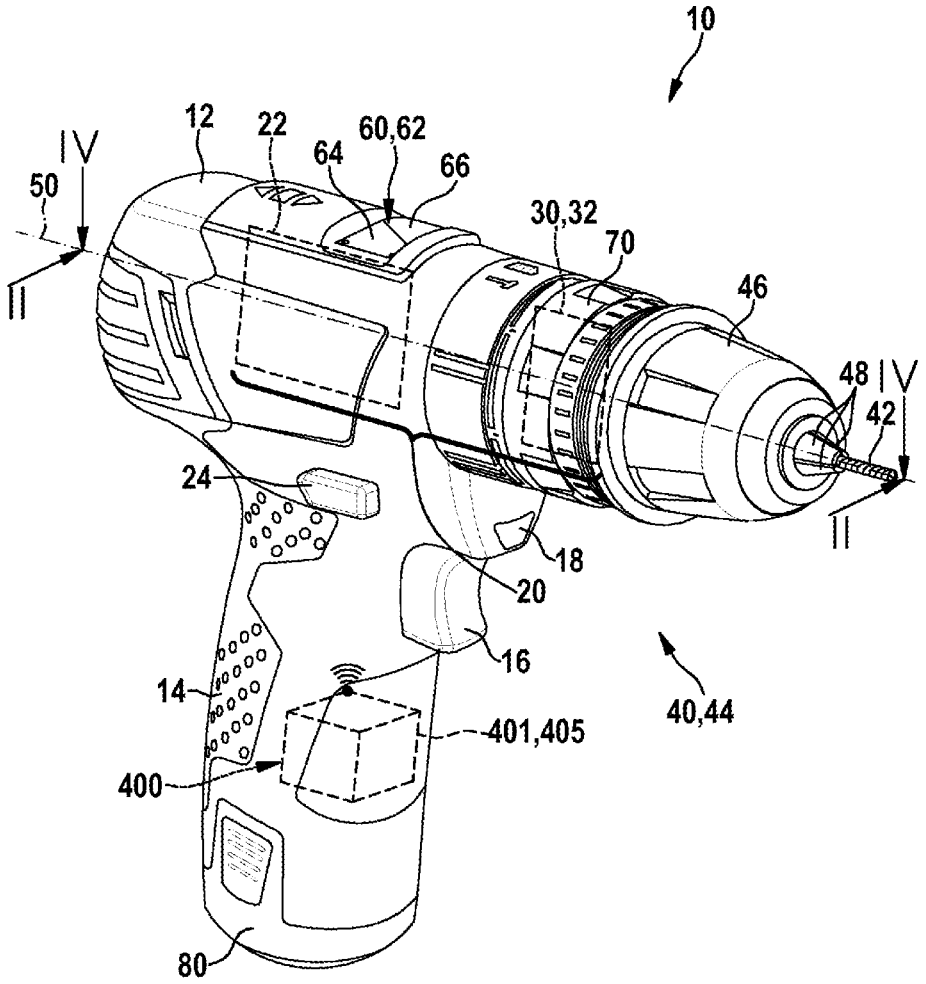
FIG. 1 shows a perspective view of a hand-held power tool.

FIG. 1 shows a hand-held power tool 10 having a tool housing 12 and a percussion mechanism 30, which hand-held power tool is, for example, in the form of a cordless percussion drill/screwdriver which can preferably be mechanically and electrically connected to a rechargeable battery pack 80 for the purpose of being supplied with power in a manner independent of the mains. However, it should be pointed out that the present disclosure should not be considered to be restricted to cordless percussion drill/screwdrivers, but rather can be used in different hand-held power tools in which the percussion mechanism 30 can be used, for example a percussion screwdriver or a percussion drill. This is also independent of whether the hand-held power tool 10 can be operated in a non-electrical or electrical manner, that is to say in a manner dependent on the mains or independent of the mains or in a battery-powered manner.

A drive unit 20 for driving an insertion tool 42 in at least one non-percussive operating mode is preferably arranged at least in sections in the tool housing 12. The drive unit 20 has, by way of example, an electrical drive motor 22, a transmission (90 in FIG. 2) which is not illustrated here and is preferably switchable, a percussion mechanism 30 which is only indicated here and is intended for the percussive driving of the insertion tool 42 held, for example, in a tool holder 40 in a percussion mode of the hand-held power tool 10, and an optional torque clutch (72 in FIG. 2). The drive motor 22, the switchable transmission (90 in FIG. 2), the optional torque clutch (72 in FIG. 2), the percussion mechanism 30 and the tool holder 40 are arranged, by way of illustration, in a rotationally symmetrical manner with respect to a longitudinal center axis 50 of the drive unit 20. The percussion mechanism 30 is preferably constructed as a so-called ratchet-controlled percussion mechanism 32. The optional torque clutch (72 in FIG. 2) can preferably be adjusted in stages by means of an adjusting ring 70 which can preferably be rotated in a latching manner about the longitudinal center axis 50, with the result that a maximum torque available at the tool holder 40 can be limited to a maximum value. The tool holder 40 is here, only by way of example, in the form of a quick-action clamping device 44 having a rotatable clamping ring 46 for radially clamping the insertion tool 42 with the aid of three clamping jaws 48, by way of example. The insertion tool 42 which is preferably exchangeable may be, for example, a drill or a bit holder with a screwdriver bit.

The tool housing 12 also has an ergonomically shaped handle 14 with a manual switch 16 for switching the electrical drive motor 22 on/off and for controlling the speed of the electrical drive motor 22 in a preferably continuously variable manner. An optional illumination device 18 which preferably emits light in the direction of the tool holder 40, can be switched on and off and is intended to illuminate a working field in the region of the tool holder 40 of the hand-held power tool 10 is also provided on the handle 14. A direction of rotation changeover switch 24 for changing the direction of rotation of the drive motor 22 in order to allow reversing operation of the hand-held power tool 10 is also preferably situated on the handle 14. The direction of rotation changeover switch 24 is preferably accommodated in the tool housing 12 in a manner transversely displaceable with respect to the longitudinal center axis 50 for actuation.

The switchable transmission (90 in FIG. 2) of the hand-held power tool 10 can be changed over at least between a first gear and a second gear. The first, preferably slow, gear is preferably assigned to the non-percussive operating mode, for example a screwing mode, and the second, preferably faster, gear is assigned to a drilling mode and/or the percussion mode. However, it is also possible to implement further gears, with the result that the drilling mode is assigned to the second gear, for example, and the percussion mode is assigned to a third gear, etc.

According to one embodiment, at least one user guidance unit 60 is provided and is used at least to change over between the non-percussive operating mode and the percussion mode. The user guidance unit 60 can be designed for active and/or passive user guidance in this case. In the case of active user guidance, a user of the hand-held power tool 10 is preferably guided, by means of visual, auditory and/or haptic instructions, advice or changeover instructions, to change over between the non-percussive operating mode and the percussion mode, whereas a corresponding changeover operation is automatically carried out by the hand-held power tool 10 in the case of passive user guidance and is preferably only indicated to the user. Exemplary implementations of active and passive user guidance are described in more detail further below. By way of example, a vibration element, for example an electric motor with an eccentric or the like, may be provided for the purpose of achieving feedback relating to whether the hand-held power tool 10 is in the non-percussive operating mode or in the percussion mode, which feedback can also be haptically perceived by the user.

The user guidance unit 60 preferably has at least one manually actuatable operating unit 62 having at least one manually actuatable operating element, but here by way of illustration a first and a second manually actuatable operating element 64, 66, wherein the operating elements 64, 66 are designed to initiate a changeover operation for changing over between the non-percussive operating mode and the percussion mode. The two operating elements 64, 66 may be implemented, for example as electrical switches, switches, latching switches, buttons, pushbuttons, for gesture control and/or with a touch-sensitive display, for example a touch-sensitive screen or a touchscreen, which are not illustrated here for the sake of better clarity of the drawing. Furthermore, the two operating elements 64, 66 may be assigned optical indication elements or illumination elements (cf. 520, 521, 522 in FIG. 6, in particular) for indicating the respectively set operating mode of the hand-held power tool 10, wherein the indication elements are preferably constructed with color or white LEDs. The user guidance unit 60 preferably also has a mobile computer, for example a smartphone and/or a tablet computer, and/or the operating elements 64, 66 are themselves in the form of a display. Alternatively, other so-called "smart devices", for example a watch, glasses etc., can also be used as the mobile computer.

Figure 5:
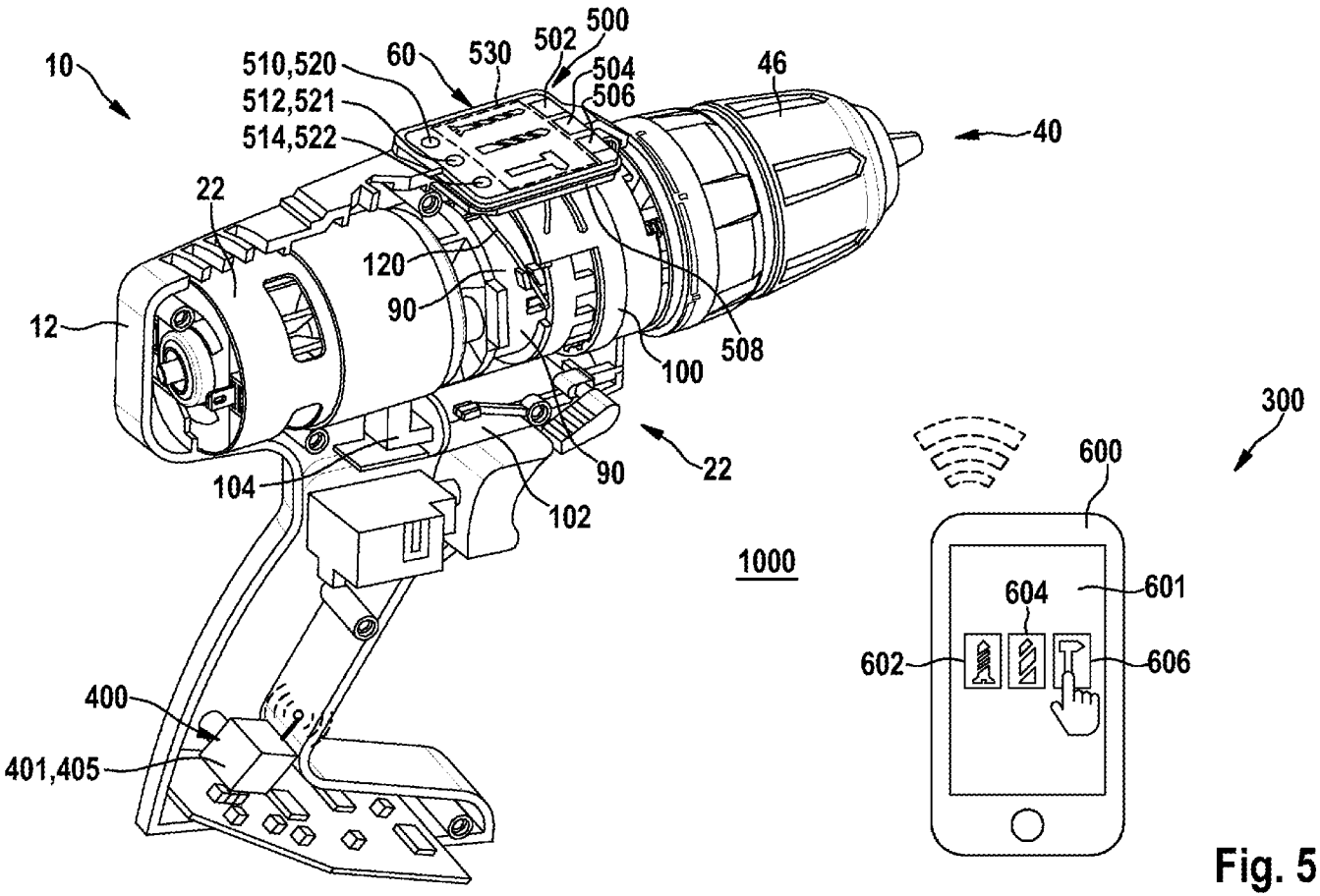
FIG. 5 shows a perspective view of a tool system consisting of the hand-held power tool from FIG. 1 and an operating unit according to a first embodiment.

According to one embodiment, the user guidance unit 60 is at least partially integrated in the hand-held power tool 10 and/or is at least partially in the form of an external separate component (300 in FIG. 5). In this case, the display can be integrated in the hand-held power tool 10 and/or can be externally arranged. Changeover instructions can preferably be indicated on the display in order to facilitate the operation of the hand-held power tool 10 and/or facilitate the setting of an application-specific operating mode of the hand-held power tool 10, for example, for a user of the hand-held power tool 10 in order to achieve optimum working results.

The hand-held power tool 10 preferably also has a bidirectional communication interface 400 which is preferably provided for the purpose of communicating with the user guidance unit 60 that can preferably be interactively operated by the user, but may alternatively also be part of the user guidance unit 60. The communication interface 400 is preferably designed to receive, at least from the user guidance unit 60 or the operating unit 62, changeover instructions for changing over the hand-held power tool 10 between the non-percussive operating mode and the percussion mode in an application-specific manner. In this case, the communication interface 400 is at least designed to transmit at least one control signal to at least one of the operating elements 64, 66 or to automatically initiate a changeover operation. In addition, provision may be made for the operating elements 64, 66 to conversely transmit an actuation signal to the communication interface 400 or to (control) electronics (not shown here) in order to communicate the fact that the user has also actually carried out the corresponding application-specific changeover. In this case, a changeover instruction for initiating a changeover operation between the percussion mode and the non-percussive operating mode can preferably be generated by at least one of the two operating elements 64, 66, for example.

According to one embodiment, the communication interface 400 is in the form of a wireless transmission module 401, in particular in the form of a radio module 405 for wireless communication by means of the Bluetooth standard. However, the transmission module 401 can also be designed for any other desired wireless and/or wired communication, for example via WLAN, WiFi and/or LAN.

Figure 2:
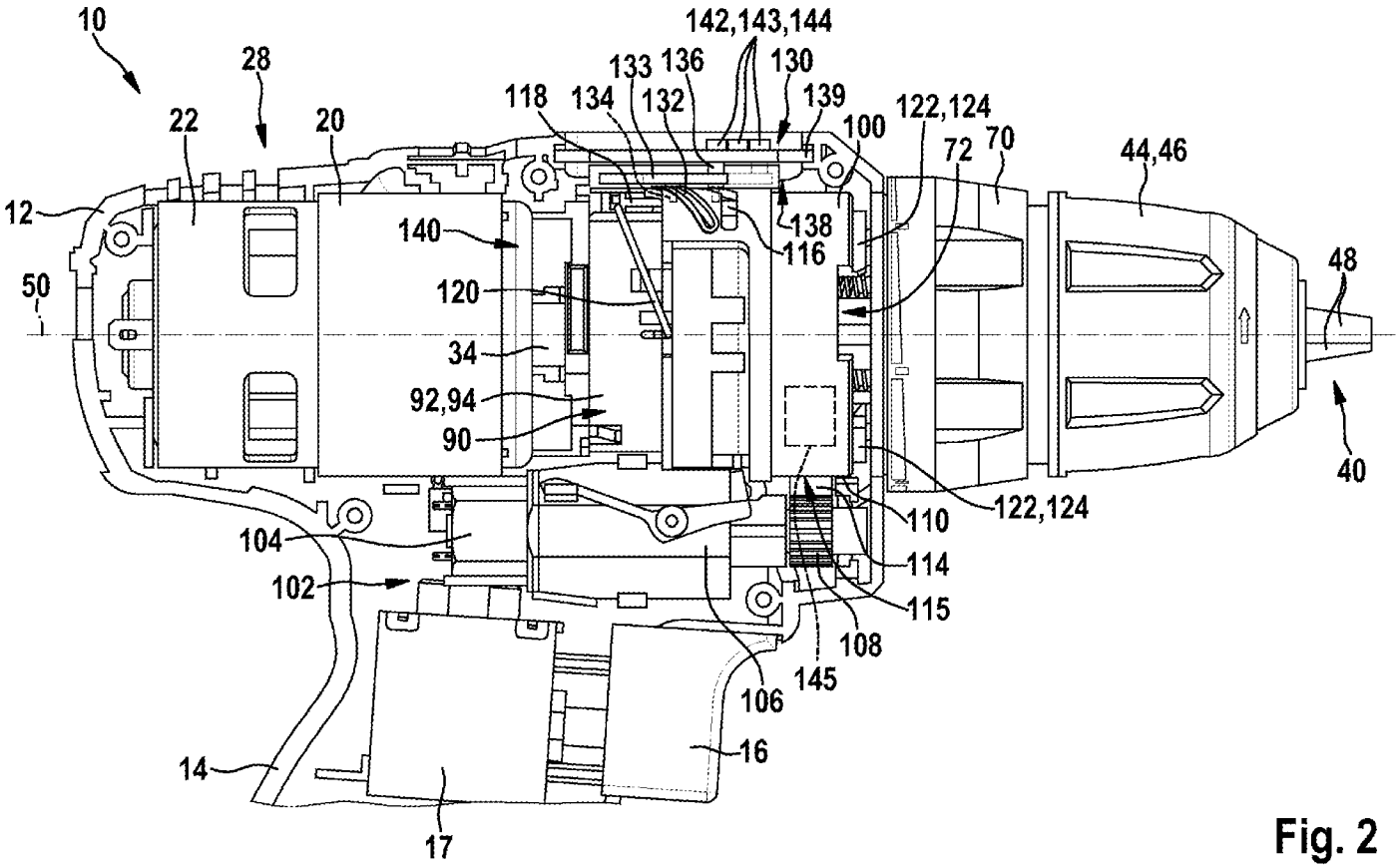
FIG. 2 shows a partial longitudinal section of the hand-held power tool from FIG. 1 according to the section line II-II from FIG. 1.

FIG. 2 shows the hand-held power tool 10 from FIG. 1 having the tool housing 12 in which the drive motor 22 is arranged as part of the drive unit 20 in a rear section 28 of the tool housing 12 which is remote from the tool holder 40 having the three clamping jaws 48. The clamping jaws 48 are radially movable by means of the clamping ring 46 of the quick-action clamping device 44, which clamping ring can be rotated about the longitudinal center axis 50. The manual switch 16 for actuating an electrical on/off switch 17 is situated in the handle 14 of the tool housing 12. A drive shaft 34 of the drive motor 22 rotationally drives, by way of illustration, a switchable transmission 90 for torque and speed adjustment, which transmission is preferably in the form of a planetary transmission 92 and has, by way of example, an at least approximately cylindrical transmission housing 94. The maximum torque which can be transmitted by an optional torque clutch 72 and can be retrieved at the tool holder 40 can be adjusted with the aid of the adjusting ring 70. The drive motor 22, the transmission 90, the optional torque clutch 72 and the percussion mechanism (30 in FIG. 1 and FIG. 4) which is concealed here are arranged, by way of example, in a rotationally symmetrical manner with respect to the longitudinal center axis 50 and are arranged in an axially offset manner with respect to one another inside the tool housing 12 of the hand-held power tool 10.

A switching ring 100 which is arranged such that it is rotatable in the tool housing 12 by means of an actuating unit 102 is preferably provided coaxially with respect to the longitudinal center axis 50 in the region of the torque clutch 70. This switching ring is preferably annular, that is to say at least approximately hollow-cylindrical, but may alternatively also be in the form of a segment of a circle or arcuate, for example.

The actuating unit 102 preferably comprises an electrical actuating motor 104 and an actuating transmission 106 which is rotationally driven by the latter and has a pinion 108 or a small gear wheel with a small number of teeth. In order to increase the torque output by the actuating motor 104 while simultaneously reducing the speed of the pinion 108, the actuating transmission 106 preferably has a high gear reduction.

On an underside 110 facing the handle 14, the switching ring 100 preferably has radially outwardly directed toothing 114 which is preferably in continuous engagement with the pinion 108 of the actuating unit 102. The toothing 114 on the underside of the switching ring 100 preferably extends here only in a circular arc section 115 of the switching ring 100 with an opening angle of preferably up to 90°. According to one embodiment, the switching ring 100 can therefore be pivoted or rotated in a motorized manner in an angular range of up to 90° or ±45° about the longitudinal center axis 50 with the aid of the actuating unit 102 or the actuating motor 104. Alternatively, a larger angular range, for example, can also be achieved with the accordingly adapted toothing 114. For example, the toothing 114 can completely encompass the switching ring 100, that is to say in the manner of 360° toothing, and can therefore enable an unlimited angular range.

On the circumference, the switching ring 100 preferably has a first slotted guide track 116 which is in the form of a ramp, by way of illustration, and in which a switching rod 118 is guided. A switching bracket 120 which is made of a bent wire and is preferably coupled to a switching ring gear (concealed here) of the transmission 90 is preferably hinged to the switching rod 118. A motorized gear changeover of the switchable transmission 90 can therefore be effected by energizing the actuating motor 104 with a particular direction of rotation. At least one deactivation element, here, for example, three deactivation elements 122 which are preferably uniformly spaced apart from one another on the circumference and of which only two deactivation elements are visible here, is/are also formed on the switching ring 100. The deactivation elements 122 are, for example, in the form of cams 124 which are integrally formed with respect to the switching ring 100, are axially directed in the direction of the tool holder 40 and are used to activate or deactivate the percussion mode or to switch the percussion mechanism 30 (not visible here) on or off by means of a blocking member (200 in FIG. 4) which is concealed here.

According to one embodiment, the switching ring 100 can be rotated at least into a first switching position and a second switching position about the longitudinal center axis 50, wherein the first switching position or rotational angle position is assigned to the non-percussive operating mode, for example, and the second switching position is assigned to the percussion mode of the hand-held power tool 10. The switching position of the switching ring 100 which is shown here by way of example is the first switching position in which the percussion mechanism 30 is switched off or the percussion mode is deactivated.

According to one embodiment, the switching ring 100 also interacts with a position detection unit 130 which is designed, inter alia, to precisely capture the respectively current switching position of the switching ring 100 and to visualize it for the user. For this purpose, a second slotted guide track 132 is preferably introduced into the switching ring 100 on the circumference, which second slotted guide track runs at least approximately in a rectilinear manner and transversely with respect to a cross section of the switching ring 100, by way of illustration. A pin-like guide element 134 which is indicated only using dashed lines and is formed on the underside of a plate-shaped base body 133 of the position detection unit 130 engages in the slotted guide track 132 of the switching ring 100. As a result, any change in the current rotational angle or the switching position of the switching ring 100 is transformed into a proportional axial displacement of a pointer-like indication element 136 of the position detection unit 130, which indication element is directed away from the guide element 134. In conjunction with a scale element which is fitted in the vicinity of the indication element 136 in the region of the tool housing 12 and is not illustrated for the sake of better clarity of the drawing, for example, the pointer-like indication element 136 then allows at least a purely mechanical indication for the user of whether the hand-held power tool 10 is in the non-percussive operating mode or in the percussion mode.

In the axial position of the position detection unit 130, as symbolized by a solid black line, the position detection unit is in a first axial detection position, whereas the position detection unit 130 in the position indicated with a dashed line is in a second axial detection position. The first detection position corresponds to the first switching position (illustrated here) of the switching ring 100 and to the non-percussive operating mode, whereas the second detection position corresponds to the second switching position of the switching ring 100, in which the percussion mode is active.

An electronic linear sensor 138 is also preferably arranged in the region of a circuit board 139 of complex electronics 140 assigned to the position detection unit 130 and is designed to detect the respectively current axial detection position of the position detection unit 130. In this case, the linear sensor 138 preferably captures the linear traversing movement of the pointer-like indication element 136 of the position detection unit 130, oriented perpendicular to the longitudinal center axis 50, and therefore indirectly the respective switching or rotational position of the actuatable switching ring 100. In this case, exact mechanical transformation of the rotational movement of the switching ring 100 into a proportional linear position of the indication element 136 is ensured by the position detection unit 130 mechanically coupled to the second slotted guide track 132.

For this purpose, the linear sensor 138 is preferably associated with at least one sensor element. By way of illustration, however, the linear sensor 138 here has three sensor elements 142, 143, 144 for better path resolution. Alternatively, an angle sensor 145 can also be used to detect a respective rotational angle position of the switching ring 100, which allows direct scanning of the respective switching or rotational position of the switching ring 100, thus making it possible to capture the switching or rotational position of the switching ring 100 with a higher degree of measurement accuracy and without play.

The preferably contactless electronic linear sensor 138 and/or the angle sensor 145 make(s) it possible to electronically capture the switching position of the switching ring 100 with a high degree of accuracy, to process it further by means of the electronics 140, for example, and to therefore implement complex control and/or regulation processes which take place automatically with the aid of the actuating unit 102. In this case, the electronics 140 preferably simultaneously control the drive motor 22 and/or the illumination device 18 from FIG. 1, wherein the drive motor 22 is preferably controlled on the basis of a direction of rotation signal transmitted by the direction of rotation changeover switch (24 in FIG. 1) which is not illustrated here. The manual switch 16 preferably has a locking mechanism which is preferably in the form of a mechanical and/or electrical locking mechanism. The on/off switch 17 and/or the electronics 140 is/are also supplied with power by the rechargeable battery pack (80 in FIG. 1).

Figure 3:
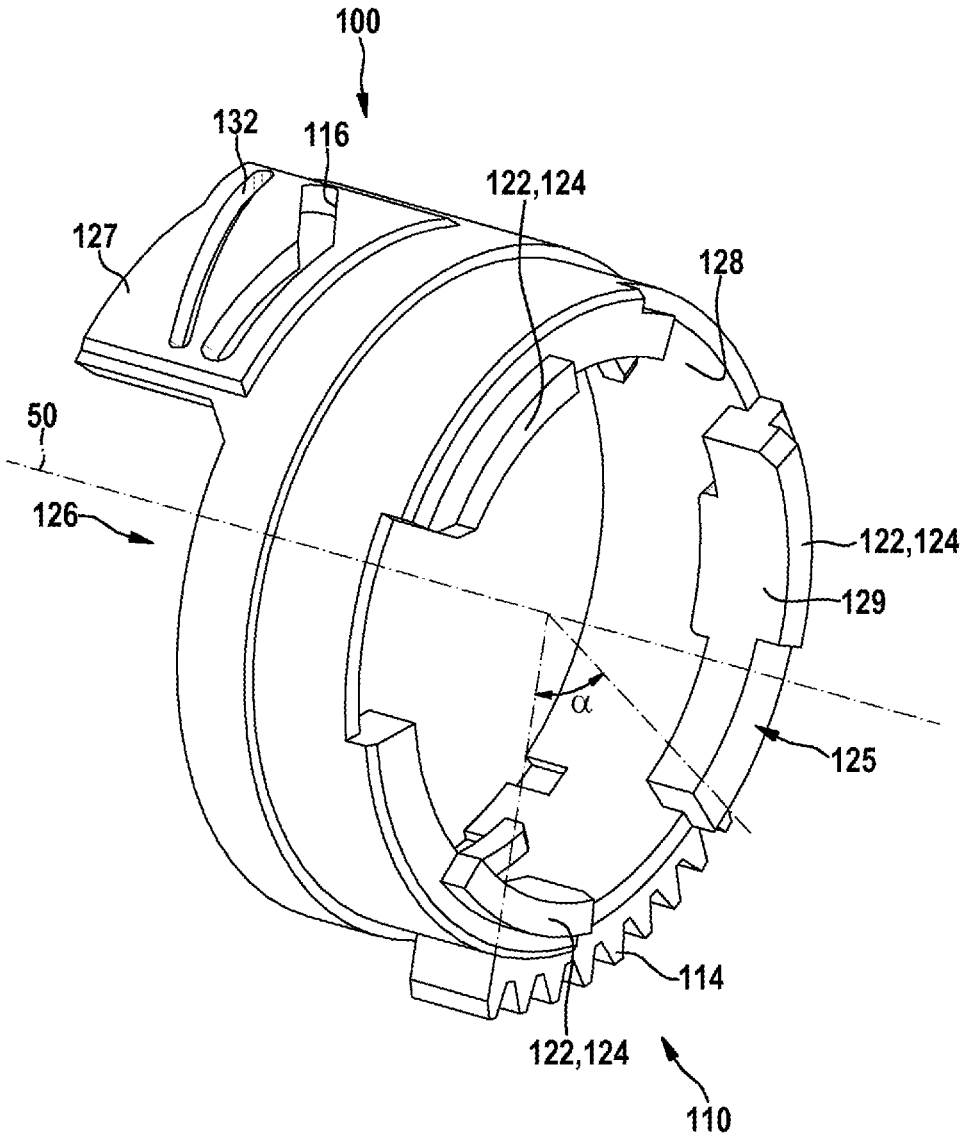
FIG. 3 shows a perspective view of a switching ring of the hand-held power tool from FIG. 2.

FIG. 3 shows the switching ring 100 of the hand-held power tool 10 from FIG. 2, which switching ring has, in the region of its underside 110 facing the pinion 108 of the actuating unit 102 from FIG. 2 in FIG. 2, the radially outwardly directed toothing 114 which is preferably formed in one piece with the switching ring 100 and extends here only by way of example on the circumference over an angle $\alpha$ of approximately 60° in order to thus allow the switching ring to be pivoted by ±30° starting from the position illustrated here. The three deactivation elements 122 which are in the form of cams 124, by way of example, are formed in the region of an end face 125 of the switching ring 100 facing the tool holder 40 from FIG. 2, preferably in one piece with the switching ring 100, and are preferably each arranged in a manner uniformly offset with respect to one another by 120° on the circumference. By way of illustration, the cams 124 each have a base area which is in the form of a sector of a circular ring, for example, and is preferably parallel to the end face 125.

A tab-like extension 127 is preferably formed at least approximately diametrically with respect to the toothing 114 on a circumferential section of a rear side 126 of the switching ring 100. Its curvature preferably corresponds to that of the switching ring 100 and its shape approximately corresponds, by way of example, to that of a rectangular section of a hollow cylinder. The two slotted guide tracks 116, 132 from FIG. 2 which preferably radially completely penetrate the extension and run approximately transversely with respect to the longitudinal center axis 50 are introduced into the extension 127.

By way of illustration, three setting cams 129 which are used to set a maximum torque which can be transmitted by the optional torque clutch (72 from FIG. 2) or a response torque of the torque clutch are also formed in the region of an approximately cylindrical inner surface 128, for example, of the switching ring 100. Of the total of three setting cams 129, only one individual setting cam is visible here. The setting cams 129 axially adjoin the cams 124 for activating or deactivating the percussion mode, but are preferably positioned in an offset manner with respect thereto on the circumference and face in the direction of the rear side 126 of the switching ring 100. The setting cams 129 also adjoin the cams 124 in a flush manner in the radial direction.

Figure 4:
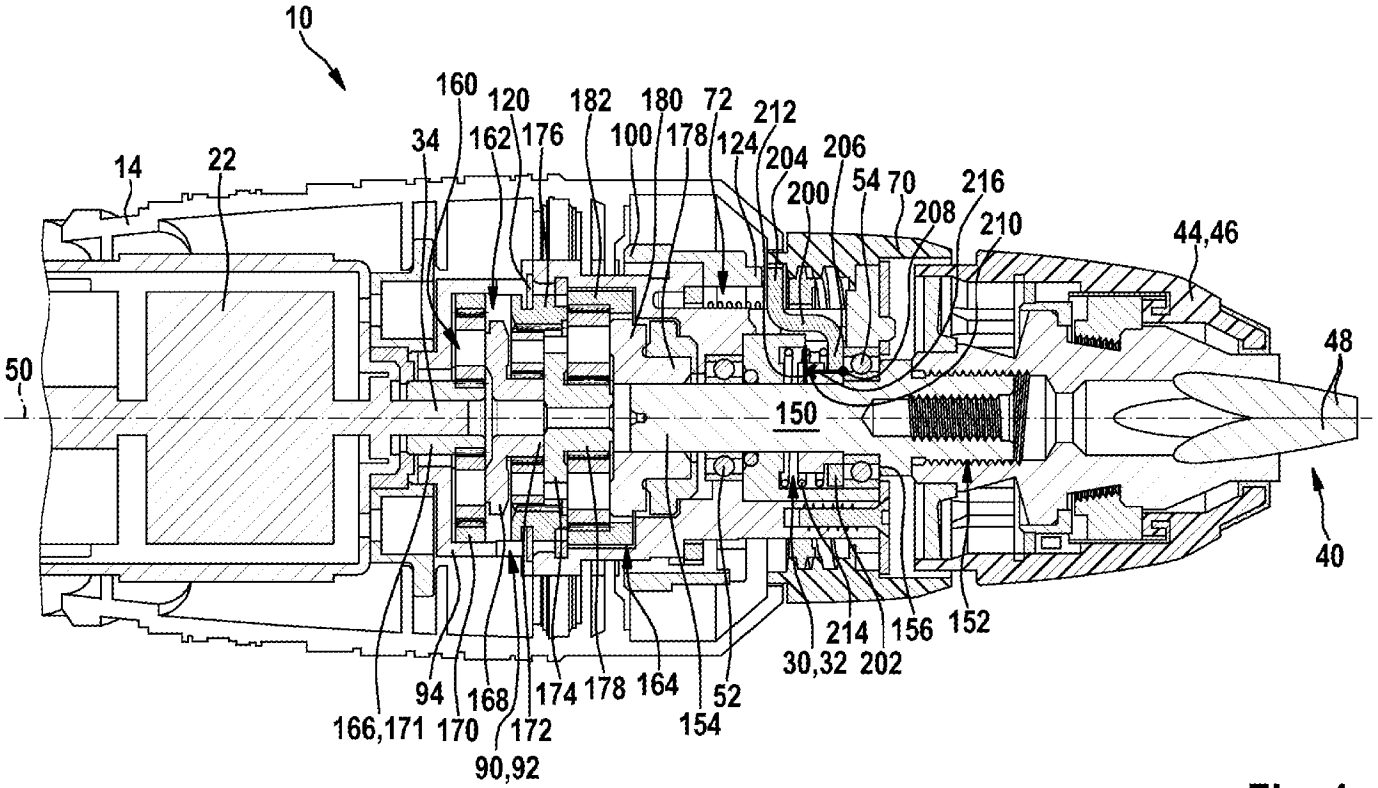
FIG. 4 shows a plan view of an enlarged longitudinal section of the hand-held power tool from FIG. 1 along the section line Iv-Iv from FIG. 1.

FIG. 4 shows the preferably switchable transmission 90 from FIG. 2 which is preferably in the form of a reduction transmission with at least two switchable transmission stages. By way of illustration, the switchable transmission 90 is here in the form of a planetary transmission 92 having three planetary stages arranged in the transmission housing 94: a front planetary stage 160 on the drive motor side, a central planetary stage 162 and a rear planetary stage 164 closest to the tool holder 40 from FIG. 2.

The front planetary stage 160 has, by way of example, a sun gear 166, at least two planetary gears which are not designated for the sake of better clarity of the drawing, a planetary carrier 168 and a ring gear 170 which is arranged in an axially immovable and rotationally fixed manner in the transmission housing 94. In order to rotationally drive the planetary transmission 92, the sun gear 166 of the front planetary stage 160 is connected to the armature shaft 34 of the drive motor 22 at least in a rotationally fixed manner, for example by means of a form-fitting connection or the like, or is in the form of an output pinion 171 of the armature shaft 34. The central planetary stage 162 accordingly has, for example, a sun gear 172 which is formed in one piece on the planetary carrier 168 of the front planetary stage 160, at least two planetary gears which are not designated, a planetary carrier 174 and the peripheral axially displaceable switching ring gear 176. The rear planetary stage 164 has, for example, a central sun gear 178 which is integrally formed on the planetary carrier 174 of the upstream central planetary stage 162, two planetary gears which are not designated and a planetary carrier 180. In addition, a ring gear 182 which is accommodated in the transmission housing 94 in an axially immovable and rotationally fixed manner and is assigned to a friction clutch which is not described any further is shown in the region of the rear planetary stage 164. The switching bracket 120 from FIG. 2 preferably engages in the switching ring gear 176, with the result that a motorized gear changeover, for example between at least a fast gear and a slow gear of the switchable transmission 90, can be effected by axially displacing the switching ring gear 176 of the central planetary stage 162 using the switching ring 100 (cf. FIG. 2, in particular) which can be rotated by means of the actuating unit 102 from FIG. 2.

An output spindle 150 which is preferably rotatably mounted at a first bearing location 52 and a second bearing location 54 in the tool housing 12 from FIG. 2 can be rotationally driven by means of the switchable planetary transmission 92 and the optional torque clutch 72 from FIG. 2 which is downstream of the latter. The two bearing locations 52, 54 are preferably constructed with radial ball bearings. The tool holder 40 from FIG. 2 having the two clamping jaws 48 which are visible here is preferably arranged in a rotationally fixed manner on a threaded section 152 of the output spindle 150. The radially inwardly directed clamping of the clamping jaws 48 is effected with the aid of the clamping ring 46 of the quick-action clamping device 44 from FIG. 2. An end section 154 of the output spindle 150 which is directed away from the threaded section 152 engages in the planetary carrier 180 of the rear planetary stage 164 and is connected to said carrier in a rotationally fixed manner.

The level of a maximum torque which can be transmitted by the optional torque clutch 72 can be set by the user using the setting ring 70 from FIG. 1. The detailed structural design of such a torque clutch is sufficiently familiar from the prior art to a person skilled in the art working in the field of hand-held power tools, and so a more detailed description can be dispensed with at this juncture.

According to one embodiment, a blocking member 200 is provided. This blocking member is here, by way of example, in the form of a bearing bridge 202 which has an approximately S-shaped cross section and has a first limb 204 and a second limb 206. The limbs 204, 206 preferably run parallel to one another and each runs transversely with respect to the longitudinal center axis 50, and a straight central section which runs parallel to the longitudinal center axis 50 and is not designated for the sake of better clarity of the drawing preferably exists between the limbs 204, 206.

In the rotational position or rotational angle position of the switching ring 100 illustrated here, the hand-held power tool 10 from FIG. 1 is in the non-percussive operating mode. In this operating mode, the first limb 204 of the bearing bridge 202 preferably axially rests against the cam 124 or the deactivation element of the switching ring 100, whereas the second bearing location 54 is axially fixed on both sides between the second limb 206 of the bearing bridge 202 and a shoulder 156 of the output spindle 150. In its illustrated position, the blocking member 200 or the bearing bridge 202 is therefore in a blocking position 208 and the percussion mode is deactivated or the non-percussive operating mode of the hand-held power tool 10 is active.

If the switching ring 100 is rotated by means of the actuating unit 102 from FIG. 2 or the actuating motor 104 from FIG. 2, the bearing bridge 202 can be axially displaced into a limitation position 212, as indicated with an arrow 210, with the result that the second bearing position 54 and, with it, the output spindle 150 can axially flex inward and outward in a periodically oscillating manner by an axial distance 216 between the blocking position 208 and the limitation position 212 on the drive motor side counter to the force applied by a spring 214, and the percussion mode of the hand-held power tool 10 or the percussion mechanism 30 preferably in the form of a ratchet-controlled percussion mechanism 32 is therefore activated. The detailed structure of such a percussion mechanism 30 or a ratchet-controlled percussion mechanism 32 is likewise sufficiently well known to a person skilled in the art from the prior art, and so a further description of said mechanism can be dispensed with at this juncture.

FIG. 5 shows a tool system 1000 having the hand-held power tool 10 from FIG. 1. The hand-held power tool 10 is provided with the user guidance unit 60 from FIG. 1 which here preferably has an operating unit 500 for manually setting the non-percussive operating mode and the percussion mode. The electrical drive motor 22 and the switchable transmission 90 for rotationally driving the tool holder 40 are situated, inter alia, in the tool housing 12 of the hand-held power tool 10.

The operating unit 500 is preferably equipped with at least one operating element, but here three operating elements 502, 504, 506 by way of illustration, for changing over between the non-percussive operating mode and the percussion mode of the hand-held power tool 10. For example, the operating element 502 is provided for the purpose of activating the screwing mode, the operating element 504 is provided for the purpose of setting a drilling mode and the operating element 506 is provided for the purpose of selecting the percussion mode, wherein the operating elements 502, 504, 506 have, by way of example, graphical symbols or pictograms corresponding to the operating modes. The operating elements 502, 504, 506 are preferably arranged on a circuit board 508 or a printed circuit board. In this case, the operating unit 500 is preferably at least partially integrated in the hand-held power tool 100. The operating unit 500 can also be equipped with an (LC) display 530 which is only indicated here using dashed lines, wherein the control signal described further above is designed, for example, to generate an indication on the display 530 for visualizing a changeover instruction or a request to initiate a changeover operation for changing over the drive unit 22 from the non-percussive operating mode to the percussion mode.

According to one embodiment, the user guidance unit 60 is at least partially in the form of an external separate component 300, as described above. In this case, the external component 300 preferably has a mobile computer 600 as a further user guidance unit, as shown here, which computer is in the form of a smartphone and/or a tablet computer, in particular. Alternatively, other so-called "smart devices", for example a watch, glasses etc., can also be used as the mobile computer. As described above, it is possible to dispense with providing the operating unit 500 under certain circumstances, in particular if the operating unit can be implemented by the mobile computer 600. In order to indicate an operating mode which has been set, the hand-held power tool 10 preferably additionally has the display 530, wherein the user guidance unit 60 forms the tool system 1000 together with the hand-held power tool 100.

The mobile computer 600 preferably has at least one electronic display 601 which is preferably in the form of a touch-sensitive screen or a touchscreen. The display 601 preferably has at least one operating element, but here three operating elements 602, 604, 606 by way of illustration, for the purpose of inputting at least one operating mode of the hand-held power tool 10. For example, the operating elements 602, 604, 606 are displayed on the display 601 in FIG. 5 as operating panels or icons or pictograms, but could also be in the form of switches and/or buttons.

If the user guidance unit 60 comprises both the operating unit 500 and the mobile computer 600, the control signal is preferably designed to generate or indicate on the display 601 a changeover instruction or a request to initiate a changeover operation for changing over between the non-percussive operating mode and the percussion mode. In this case, specific (handling) instructions are preferably indicated using the display 601, for example an instruction relating to which operating mode is intended to be set for a predefined work process, which operating mode can then be set by a user of the hand-held power tool 10, for example via the operating unit 500 on the hand-held power tool 10. In this case, the operating elements 502, 504, 506 on the hand-held power tool 10 can be provided with light-emitting illumination means 510, 512, 514, wherein the control signal in this constellation is designed to respectively switch on the corresponding illumination means 510, 512, 514. The illumination means 510, 512, 514 are preferably implemented using spatially compact illumination elements 520, 521, 522, for example color or white LEDs.

In addition, the mobile computer 600 can also be at least partially integrated in the hand-held power tool 10, wherein the respective operating mode is then preferably automatically set in such a constellation, preferably using the electromotive actuating unit 102 or the actuating motor 104 from FIG. 2. It should also be pointed out that the exemplary implementations of the user guidance unit 60 which are described in FIG. 5 can be combined with one another in any desired manner and the communication interface 400 can also concomitantly undertake the functionality of the user guidance unit 60, for example.

Figure 6:
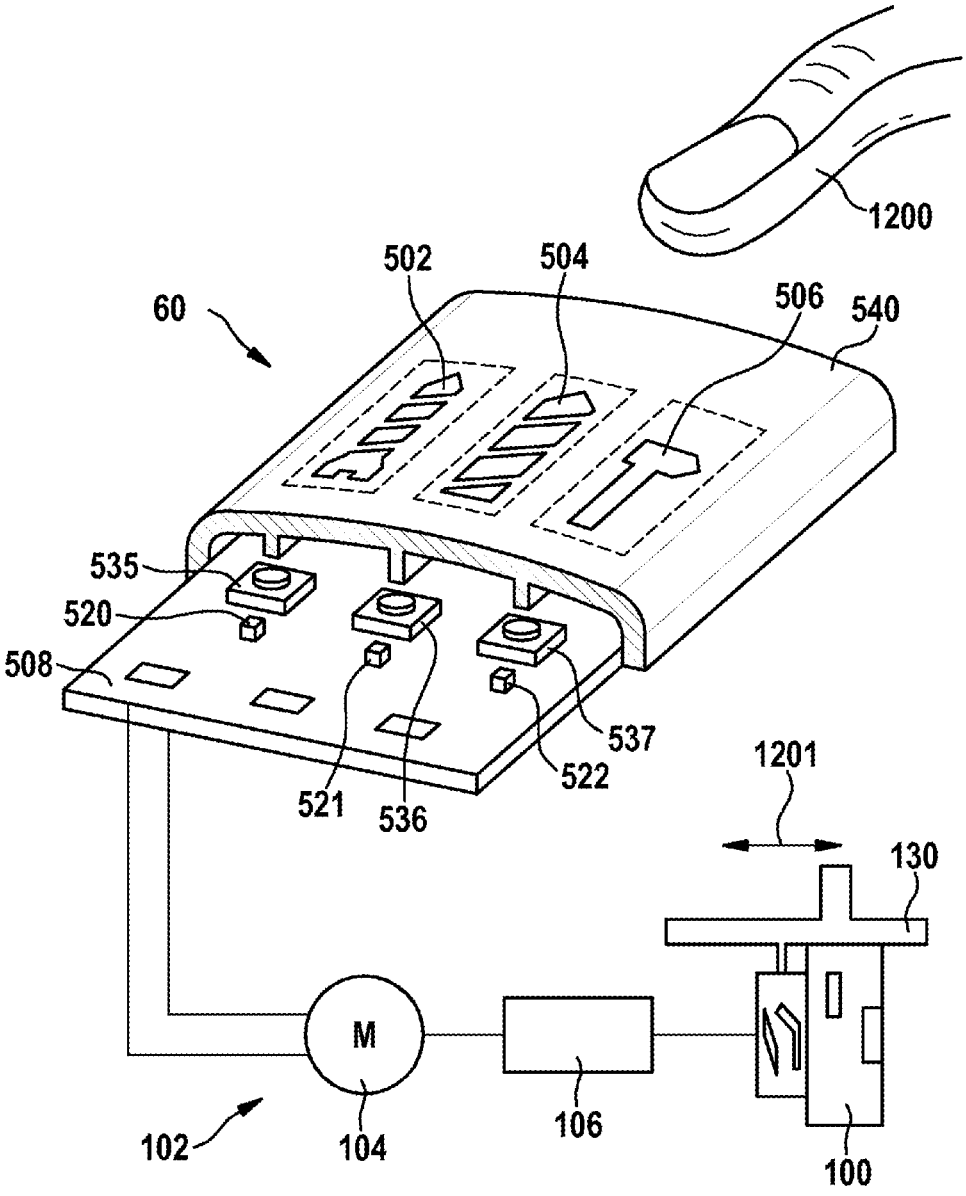
FIG. 6 shows a perspective detailed view of the operating unit from FIG. 5 and the actuating unit from FIG. 2.

FIG. 6 shows the operating unit 500 from FIG. 5 with the operating elements 502, 504, 506 and the actuating unit 102 from FIG. 2. The operating unit 500 preferably has at least one electrical switching element, but here three electrical switching elements 535, 536, 537 by way of example. Three illumination elements 520, 521, 522 (cf. FIG. 5) are preferably provided for the purpose of indicating a respectively set operating mode. In this case, one of the electrical switching elements 535, 536, 537 is respectively uniquely assigned to one of the illumination elements 520, 521, 522 and to one of the operating elements 502, 504, 506. By way of illustration, the switching element 535 and the illumination element 520 are assigned to the operating element 502 (screwing mode), the switching element 536 and the illumination element 521 are assigned to the operating element 504 (drilling mode) and switching element 537 and the illumination element 522 are assigned to the operating element 506 (percussion mode).

The three illumination elements 520, 521, 522 can preferably be activated at least for the purpose of automatically indicating the changeover instruction for initiating a changeover operation for changing over the percussion mechanism (30, 32 in FIG. 2) between the non-percussive operating mode and the percussion mode. The electrical switching elements 535, 536, 537 are preferably in the form of switches or pushbuttons and/or the illumination elements 520, 521, 522 are implemented using color or white LEDs. Alternatively, the operating unit 500 can also be in the form of an (LC) display, preferably with a touchscreen functionality, and/or in the form of a mobile computer, wherein a symbol to be respectively actuated by the user on the display or an icon can respectively light up and/or flash.

The operating unit 500 preferably interacts with the actuating unit 102 which is constructed from the actuating motor 104 and the actuating motor transmission 106 and is in turn mechanically connected to the rotatable or pivotable switching ring 100 (cf. FIGS. 2 to 4), with the result that the user can conveniently set an operating mode of the hand-held power tool 10 from FIG. 1 using a finger 1200. The current position of the switching ring 100 is respectively captured in this case by the position detection unit (cf. FIG. 2, in particular) which is axially displaced along a double-headed arrow 1201 in a manner proportional to the current (rotational) angle of the switching ring 100.

In order to protect against contamination, the electrical circuit board 508 of the operating unit 500 preferably has an elastic membrane cover 540 in the form of a membrane keyboard which is transparent at least in the region of the illumination elements 520, 521, 522 and makes it possible to smoothly actuate the switching elements 535, 566, 537 underneath. The illumination elements 520, 521, 522 can also be placed directly below the operating elements 502, 504, 506 and the symbols or pictograms respectively associated with them for the screwing mode, the drilling mode and the percussion mode. As a result, an operating mode to be actively set by the user or an operating mode automatically selected by the hand-held power tool can be visualized by the illumination of the corresponding symbol in order to achieve optimum working results in a particular application scenario.

Figure 7:
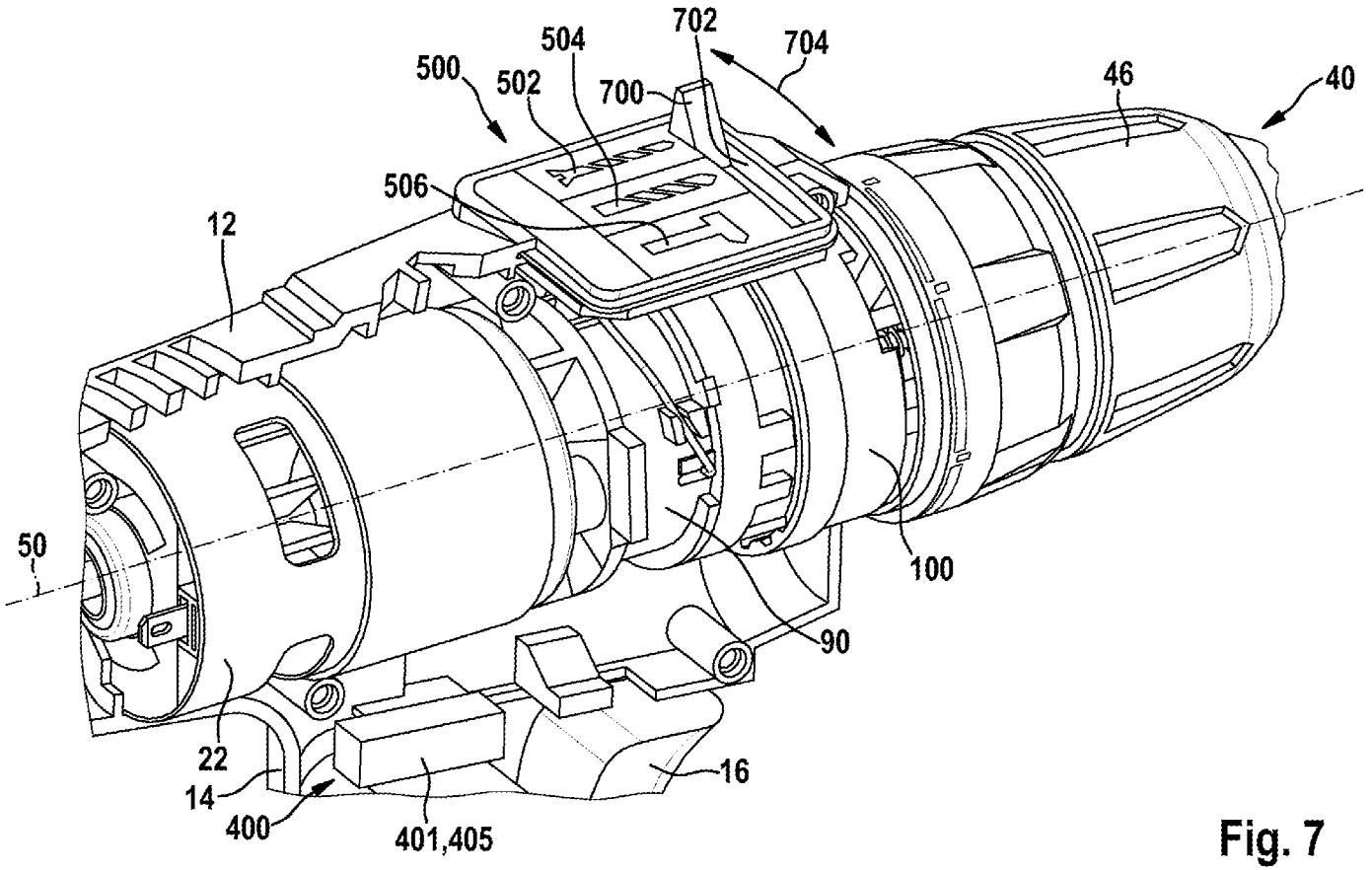
FIG. 7 shows a perspective partial view of the hand-held power tool from FIG. 1 with an operating unit according to a second embodiment.

FIG. 7 shows the operating unit 500 from FIG. 5 which, according to one embodiment, has a setting element 700 for manually selecting the respective operating mode. The tool housing 12 from FIG. 2 comprises, inter alia, the drive motor 22, the manual switch 16, the switchable transmission 90, the rotatable switching ring 100, the tool holder 40 and the communication interface 400 integrated in the tool housing 12 in the region of the handle 14.

A lever-like setting element 700 is preferably integrally formed with respect to the actuatable switching ring 100 from FIG. 2 to FIG. 4 and projects radially from a recess 702 in the operating unit 500 in relation to the longitudinal center axis 50. Pivoting the setting element 700 in the direction of a double-headed arrow 704 preferably rotates the switching ring 100, as a result of which the respective operating mode can be directly set. In a similar manner to FIG. 5 and FIG. 6, the operating elements 502, 504, 506 which preferably do not have a switching functionality here have graphical symbols or pictograms corresponding to the respective operating modes (screwing mode, drilling mode, percussion mode). In the pivot position of the setting element 700, as illustrated in FIG. 7, a non-percussive operating mode of the hand-held power tool 10 from FIG. 1, in particular the screwing mode, is selected, for example.

Figure 8:
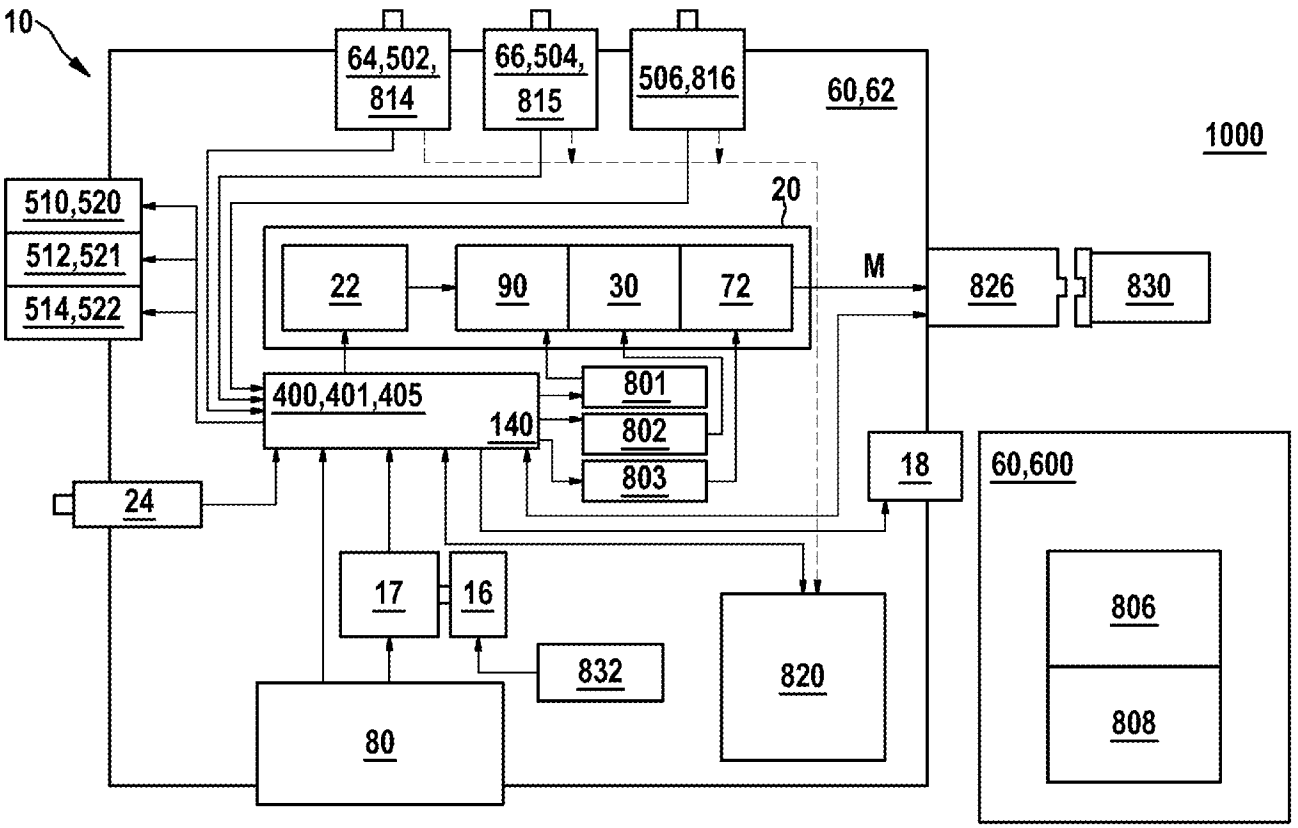
FIG. 8 shows a block diagram of the tool system from FIG. 5 having the hand-held power tool and the mobile computer from FIG. 5.

FIG. 8 shows a block diagram of the tool system 1000 from FIG. 5 having the hand-held power tool 10 and the mobile computer 600. Accordingly, the hand-held power tool 10 again comprises, inter alia, the drive unit 20 having the drive motor 22, the transmission 90, the percussion mechanism 30 and the optional torque clutch 72.

The electronics 140 from FIG. 2 preferably control at least one actuator 801, 802, 803. Three actuators 801, 802, 803 are provided by way of example in FIG. 8, wherein the actuator 801, for example, is designed to change over the gear of the transmission 90, the actuator 802 is designed to activate/deactivate the percussion mechanism 30 and the actuator 803 is designed to set a maximum torque M which can be transmitted by the optional torque clutch 72. If one of the three actuators 801, 802, 803 is activated, the electronics 140 preferably forward an activation signal to an assigned illumination means 510, 512, 514 or at least one of the illumination elements 520, 521, 522 (cf. FIG. 5 and FIG. 6, in particular). Alternatively or additionally, the activation signal may also be in the form of a signal tone or a haptically perceptible (vibration) signal.

According to one embodiment, the mobile computer 600 has an interactive first program 806 and an interactive second program 808, in particular a smartphone app, for communicating with the communication interface 400 of the hand-held power tool 10. In this case, the first program 806 is preferably designed to set specific applications, for example in order to screw a screw into softwood or hardwood. In this case, the program 806 preferably determines the operating parameters which are best suited to achieving optimum working results, for example a speed, a direction of rotation, a torque, a gear and/or a percussion operation requirement, for the respective application and forwards said parameters to the communication interface 400 of the hand-held power tool 10.

In this case, the communication interface 400 is preferably designed to transmit a control signal to the actuators 801, 802, 803 of the hand-held power tool 10, wherein at least one actuator 801 is designed to change over the switchable transmission 90 between at least two gears when activated by the communication interface 400. Furthermore, the actuator 802, for example, is designed to change over between the non-percussive operating mode and the percussion mode of the percussion mechanism 30 of the hand-held power tool 10 when activated by the communication interface 400. Accordingly, the third actuator 803 is used, for example, to change the maximum torque M which can be transmitted by the optional torque clutch 72. In this case, the communication interface 400 preferably forwards the control signal to the electronics 140 which then activate or control the respective assigned actuators 801, 802, 803.

The second program 808 is alternatively or additionally provided and is designed to set at least one particular operating parameter, for example a speed, a direction of rotation, a torque, a gear and/or a percussion operation requirement. In this constellation, a user of the hand-held power tool 10 directly specifies the desired operating parameters via the program 808. These parameters are then transmitted to the communication interface 400 of the hand-held power tool 10, wherein the communication interface 400 forwards a corresponding control signal, as described above.

Alternatively or additionally, the hand-held power tool 10 may have at least one signal transmitter 814, 815, 816 or at least one of the operating elements 502, 504, 506 (cf. FIG. 5 and FIG. 6, in particular) for manually setting a gear and/or an operating mode or for manually setting operating parameters. In this case, provision may be made for at least one signal transmitter 814, 815, 816 to transmit an actuation signal to the communication interface 400 and/or the electronics 140. Three signal transmitters 814, 815, 816 are shown, by way of example, in FIG. 8. In this case, the signal transmitter 814, for example, is designed to change over the gear, the signal transmitter 815 is used to activate and/or deactivate the percussion mechanism 30 and the signal transmitter 816 has the function of setting the torque of the optional torque clutch 72.

The respective signal transmitter 814, 815, 816 is preferably designed to transmit a control signal to the electronics 140 in an application-specific manner or depending on the input, with the result that the electronics 140 can accordingly activate and/or control the respective actuators 801, 802, 803. In this case, the signal transmitters 814, 815, 816 are preferably in the form of electrical signal transmitters, in particular in the form of switches or pushbuttons, but may also be in the form of any other desired signal transmitters, for example in the form of a mechanically displaceable lever arm or the like.

In addition, the user guidance unit 60 (cf. FIG. 1, FIG. 5 and FIG. 6, in particular) comprising the operating unit 62 may be assigned a display and/or the mobile computer 600 which, as described above, indicates changeover instructions or requests to change over between the non-percussive operating mode and the percussion mode of the hand-held power tool 10 in an application-specific manner. In this case, the changeover instructions can be visualized on the display and/or the mobile computer 600 using symbolic and/or text-based step-by-step instructions, using pictograms or the like. In this case, the at least one operating element 64, 66 (cf. FIG. 1, in particular) for initiating a changeover operation for changing over between the non-percussive operating mode and the percussion mode preferably has a sensor 820 which is designed to transmit an actuation signal as feedback for the electronics 140 to the communication interface 400 and/or the mobile computer 600 (cf. FIG. 6, in particular) when the at least one operating element 64, 66 is actuated by the user, with the result that a respective next step of the changeover instruction can be indicated.

Furthermore, the sensor 820 can also be in the form of an internal and/or external sensor for monitoring and/or optimizing the workflows of the hand-held power tool 10. For example, the sensor 820 may be in the form of a temperature sensor, an acceleration sensor, a magnetic field sensor, a 3-D position sensor etc. In this case, it is possible to store a further program or software or a smartphone app which is designed to check the settings of the electronics 140 or of the hand-held power tool 10 and to adapt them if necessary. For example, in the event of thermal overheating of the drive motor 22, a warning signal can be output and/or the percussion mode can be deactivated. Furthermore, in the event of thermal overloading of the drive motor 22 on account of an excessively high torque present at the tool holder, an automatic gear changeover can be initiated.

An adapter interface 826 for connection to at least one adapter 830 can also be provided. In this case, the adapter interface 826 can be in the form of a mechanical interface, an electrical interface and/or an electronic data interface, wherein the adapter 830 is designed to transmit information and/or control signals, for example a torque, a speed, an electrical voltage, an electrical current and/or further data, to the hand-held power tool 10. In the case of an adapter interface 826 in the form of a data interface, the adapter 830 preferably has a transmission unit (not illustrated). The adapter 830 can preferably be in the form of a distance meter, for example, and can transmit determined measured values or parameters to the electronics 140 of the hand-held power tool 10 via the adapter interface 826. In this case, the adapter 830 can be used with and/or without the drive unit 22. The adapter 830 can preferably be activated via the mobile computer 600, in which case the latter or the display can visualize activation of the adapter 830. The electronics 140 preferably also control the drive motor 22 and/or the illumination device 18 of the hand-held power tool 10, wherein the drive motor 22 is preferably controlled on the basis of a direction of rotation signal transmitted by the direction of rotation changeover switch 24. The manual switch 16 preferably has a (safety) locking mechanism 832 which is preferably in the form of a mechanical and/or electrical locking mechanism. Furthermore, the electrical on/off switch 17 and/or the electronics 140 is/are supplied with power by the rechargeable battery pack 80.

Figure 9:
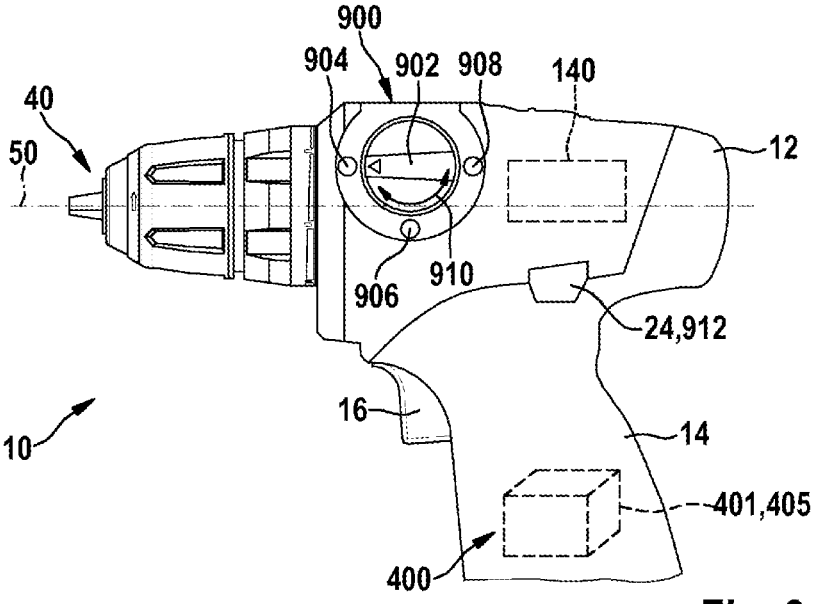
FIG. 9 shows a partial side view of the hand-held power tool from FIG. 1 having an operating unit according to a third embodiment.

FIG. 9 shows the hand-held power tool 10 from FIG. 1 with the tool housing 12 and the handle 14 integrally formed on the underside thereof and the optional communication interface 400 positioned in said handle, the manual switch 16, the direction of rotation changeover switch 24 and the tool holder 40. The hand-held power tool 10 here has, by way of example, an operating unit 900 which, unlike all embodiments described above, has a handle-like rotary switch 902 at least for changing over between the non-percussive operating mode and the percussion mode.

The rotary switch 902 is preferably respectively assigned an illumination means 904, 906, 908 or an illumination element for the non-percussive operating mode and the percussion mode. For example, the illumination means 904, 906 are preferably allocated to two non-percussive operating modes, for example a screwing mode and a drilling mode, whereas the illumination means 908 is assigned to the percussion mode, for example. The circularly positioned illumination means 904, 906, 908 are preferably implemented using color LEDs or white LEDs.

By rotating the rotary switch 902 in the direction of a double-headed arrow 910, the user can easily change over between said operating modes of the hand-held power tool 10. In this case, the rotary switch 902 can carry out a maximum rotational angle of 180°, for example. The illumination means 904, 906, 908 can possibly be used to directly cause transparent graphical symbols for the screwing mode, the drilling mode and the percussion mode to light up at least in certain areas in order to further optimize the operating comfort of the hand-held power tool 10.

As already explained within the scope of the description of FIG. 8, the electronics 140 and/or the communication interface 400, for example, can be used to activate that illumination means 904, 906, 908 which indicates the operating mode that differs from the current operating mode, is currently predefined by the tool and should therefore be set and to which the user is intended to change over the hand-held power tool 10 in order to achieve working results which are as optimum as possible in a specific application by rotating the rotary switch 902 in one of the two directions of the double-headed arrow 910. In addition, a further illumination means 912 can be integrated in the at least partially transparent direction of rotation changeover switch 24 in order to signal to the user, for example, the requirement to reverse the direction of rotation of the tool holder 40 and therefore of the insertion tool. This may be the case, for example, if the electronics 140 determine a fast torque increase, which indicates, for example, a drill which is stuck or jammed in the workpiece and can preferably be removed by at least briefly changing the direction of rotation of the tool holder 40.

The four illumination means 904, 906, 908, 912 of the hand-held power tool 10 are therefore used to initiate a complex usage action by the user within the scope of passive user guidance, in which case the type of actuation required and/or the operating element itself to be actuated, here by way of example the rotation of the rotary switch 902 or the axial-transverse displacement of the direction of rotation changeover switch 24 with respect to the longitudinal center axis 50, is/are simultaneously conveyed to the user in a simple and intuitively perceptible manner.

Figure 10:
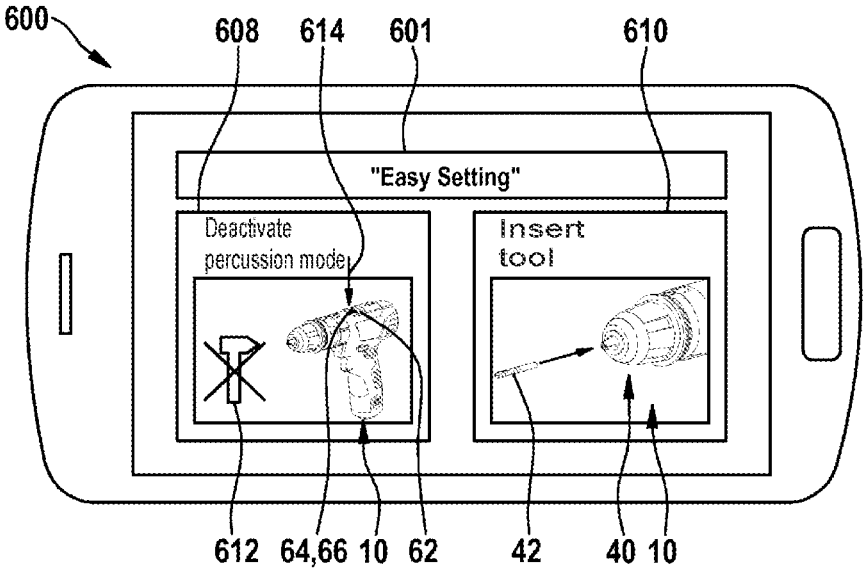
FIG. 10 shows an enlarged view of the mobile computer of the tool system from FIG. 5.

FIG. 10 shows the mobile computer 600 of the tool system 1000 from FIG. 5. By way of example, a first changeover instruction 608 and a second changeover instruction 610 or a request to initiate intervention by the user is/are indicated on the display 601 of the mobile computer 600 graphically and textually by means of one of the programs (806, 808 in FIG. 8) or a smartphone app or a tablet app.

The first changeover instruction 608 or request is intended to prompt the user, for example, to deactivate the percussion mode or to change to the at least one non-percussive operating mode of the hand-held power tool 10, for example by actuating one of the two operating elements 64, 66 of the operating unit 62. For this purpose, a graphical illustration is provided by a symbol 612 or a pictogram and/or an arrow 614 which provides the user with a clear indication of the operating element 64, 66 to be actuated in the specific application on the hand-held power tool 10.

The second changeover instruction 610 or request is issued to the user in order to prompt the latter, for example, to insert and clamp a particular insertion tool 42 which is respectively optimally suitable for the currently pending application process, for example a wood drill, a metal drill or a masonry drill or the like, in the tool holder 40 of the hand-held power tool 10 from FIG. 1. In order to make this possible, the user may be queried with regard to the details of the application or work task to be processed thereby by means of a further interactive program or program module running on the mobile computer 600, with the result that a suitable changeover instruction 610 or request can then be issued to the user, which instruction or request specifies, for example, the type of insertion tool to be inserted into the tool holder.

The invention claimed is:

1. A hand-held power tool system, comprising:

a drive unit in a hand-held power tool and configured to drive an insertion tool in at least one non-percussive operating mode, the drive unit including a percussion mechanism for percussive driving of the insertion tool in an associated percussion mode;

a user guidance unit configured to be actuated by a user;

an actuating motor configured to change over the drive unit between the at least one non-percussive operating mode and the associated percussion mode when activated; and a communication interface configured to transmit a control signal to the actuating motor to activate the actuating motor to carry out a changeover operation changing over the drive unit between the at least one non-percussive operating mode and the associated percussion mode in an application-specific manner without user intervention, and configured to communicate with the user guidance unit and control the user guidance unit to indicate to a user the changeover operation that has been carried out without user intervention.

2. A hand-held power tool system, comprising:

a drive unit in a hand-held power tool and configured to drive an insertion tool in at least one non-percussive operating mode, the drive unit including a percussion mechanism for percussive driving of the insertion tool in an associated percussion mode;

a user guidance unit configured to be actuated by a user;

at least one actuator configured to change over the drive unit between the at least one non-percussive operating mode and the associated percussion mode when activated; and a communication interface configured to transmit a control signal to the at least one actuator to activate the at least one actuator to carry out a changeover operation changing over the drive unit between the at least one non-percussive operating mode and the associated percussion mode in an application-specific manner without user intervention, and configured to communicate with the user guidance unit and control the user guidance unit to indicate to a user the changeover operation that has been carried out without user intervention.

* * * * *